US005319868A

United States Patent [19]

Hallenbeck

[11] Patent Number: 5,319,868

[45] Date of Patent: Jun. 14, 1994

[54] SHOE, ESPECIALLY AN ATHLETIC, LEISURE OR REHABILITATION SHOE HAVING A CENTRAL CLOSURE

[75] Inventor: Barry Hallenbeck, Nashua, N.H.

[73] Assignee: Tretorn AB, Helsingborg, Sweden

[21] Appl. No.: 63,710

[22] Filed: May 21, 1993

[30] Foreign Application Priority Data

Jul. 22, 1992 [DE] Fed. Rep. of Germany ... 9209702[U]

[51] Int. Cl.[5] ..... A43B 11/00

[52] U.S. Cl. ..... 36/50.1; 36/54; 36/50.5

[58] Field of Search ..... 36/50.1, 50.5, 51, 54; 24/712.1, 712.5, 712.9, 713, 71.2, 68 SK

[56] References Cited

U.S. PATENT DOCUMENTS

| | | | |
|---|---|---|---|
| 716,528 | 12/1902 | Flowers | 36/50.1 |
| 2,345,057 | 3/1944 | Marinetti | 36/50.1 |
| 2,994,935 | 8/1961 | Buchholz . | |
| 3,808,644 | 5/1974 | Schoch | 36/50.1 |
| 4,261,081 | 8/1981 | Lott | 24/71.2 |
| 4,622,763 | 11/1986 | Adams | 36/50.1 |
| 4,653,204 | 3/1987 | Morell et al. | 36/50.5 |
| 4,726,126 | 2/1988 | Bernhard . | |
| 4,727,660 | 3/1988 | Bernhard . | |
| 4,870,723 | 10/1989 | Pozzobon et al. | 36/50.5 |
| 5,065,481 | 11/1991 | Walkhoff | 36/50.5 |
| 5,117,567 | 6/1992 | Berger | 36/50.1 |
| 5,177,882 | 1/1993 | Berger | 36/50.1 |

FOREIGN PATENT DOCUMENTS 2501977 9/1982 France .

*Primary Examiner*—Paul T. Sewell
*Assistant Examiner*—Marie D. Patterson

[57] ABSTRACT

A shoe having a three-quarter or high top upper that is formed at least partially of flexible material has a central rotary closure on an instep cover in a section between the metatarsophalangeal joint area and the ankle joint area, especially near ankle joint area, and is coupled with at least two tightening elements, one tightening element of central rotary closure acting to close the portion of the throat area extending from the closure toward the shoe tip and the other one or two of the tightening elements running upward, especially at an angle ($\alpha$) relative to horizontal which is about 10° to 50°, especially about 20° to 40°, over a guide element on the upper material at or above the central rotary closure, and ending at an attaching point on the instep cover located approximately at at least the same height as the top of this guide element, so that a tightening action can be produced toward the rear in an area between the top and bottom of the heel portion of the upper.

19 Claims, 1 Drawing Sheet

SHOE, ESPECIALLY AN ATHLETIC, LEISURE OR REHABILITATION SHOE HAVING A CENTRAL CLOSURE

BACKGROUND OF THE INVENTION

This invention relates to a shoe, especially an athletic, leisure or rehabilitation shoe, with an upper part consisting, at least partially, of a flexible material which covers the ankle of the foot (¾ mid-height) or rises above the ankle (high top). More specifically, the invention relates to a shoe of this type which is provided with an instep cover covering the instep of the foot (which is movable like a tongue or forms the tongue or a part of it) on which a central rotary closure is provided, with which at least the instep length of a tightening element can be shortened for closing the shoe and can be extended for opening it, and the tightening element is alternately guided respectively from a guide element on the upper side part to a guide element of the instep cover.

Such a sport shoe is known, for example, from commonly owned, co-pending U.S. patent application Ser. No. 08/010,385, and low top versions of such shoes are disclosed in U.S. Pat. Nos. 5,177,882 and 5,117,567. In using the known central closure of the noted patents for shoes which have a very large open throat area or in shoes with a high top upper, which by nature have a greater throat area, the central rotary closure has to be able to accommodate a large lengthwise section of the tightening element in the closed position. Therefore, it has to have a correspondingly large winding space for the tightening element. Otherwise, to obtain an effective closure, as disclosed in the noted co-pending patent application, a more complex double-reel central closure must be used with multiple tightening elements.

Moreover with greater instep length, the ratio of the tightening action to the angle of rotation is small because of the originally small diameter of the winding element of the central rotary closure and increases with increases in the length wound, i.e., the effective diameter of the reel increase as the tightening element is wound thereon so that a greater length of the tightening element will be wound on the reel each successive turn thereof. But, to tighten the tightening element, especially the opposite result would be more favorable, namely a shorter length of the tightening element being wound on the reel with each successive turn thereof at the end of the tightening process, so that a better fine-tuning of the fit would be possible.

Sliding closures for shoes are also known; for example, a sliding closure is known from U.S. Pat. No. 2,994,935 which extends over the entire length of the tongue. It consists of a relatively rigid material. A good matching of the shoe in this sliding area to the shape of the foot is, therefore, not possible. A shortening of the sliding path of the sliding closure is not possible because of the necessary opening angle of the upper side parts and the, thus, necessary large instep length of the tightening element. Therefore, such sliding closures could not catch on in the market.

Similarly, zipper-type closures are known, for example, from U.S. Pat. No. 2,345,057 and French Utility Model Publication 2501977. These closures, which are attached to the shoe upper by conventional shoe laces, also, extend over the entire length of the tongue.

SUMMARY OF THE INVENTION

In view of the foregoing, it is a primary object of the present invention to achieve a quick closure of a shoe with a central rotary closure, while maintaining its usual size for low top shoes, also in shoes to be opened wide and in those with a high top upper, for example, in basketball or volleyball shoes.

This object and others are achieved in accordance with the present invention are achieve in a shoe of the initially-mentioned type by locating the central rotary closure on the instep cover in the section between the metatarsophalangeal joint area and the ankle joint area, especially near ankle joint area, and is coupled with two or three tightening elements, one tightening element of central rotary closure acting to close the portion of the throat area extending from the closure toward the shoe tip and the other one or two of the tightening elements running upward, especially at an angle ($\alpha$) relative to horizontal which is greater than about 10° to 50°, especially greater than about 20° to 40°, over a guide element on the upper material at or above the central rotary closure, and ending at an attaching point on the instep cover located approximately at at least the same height as the top of this guide element, so that a tightening action can be produced toward the rear in an area between the top and bottom of the heel portion of the upper.

By the common use of tightening elements running downward or upward, the central rotary closure—as is known—can be placed in the instep area, and nevertheless, a wide opening and a good tightening action in the area above the ankle joint can be achieved.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
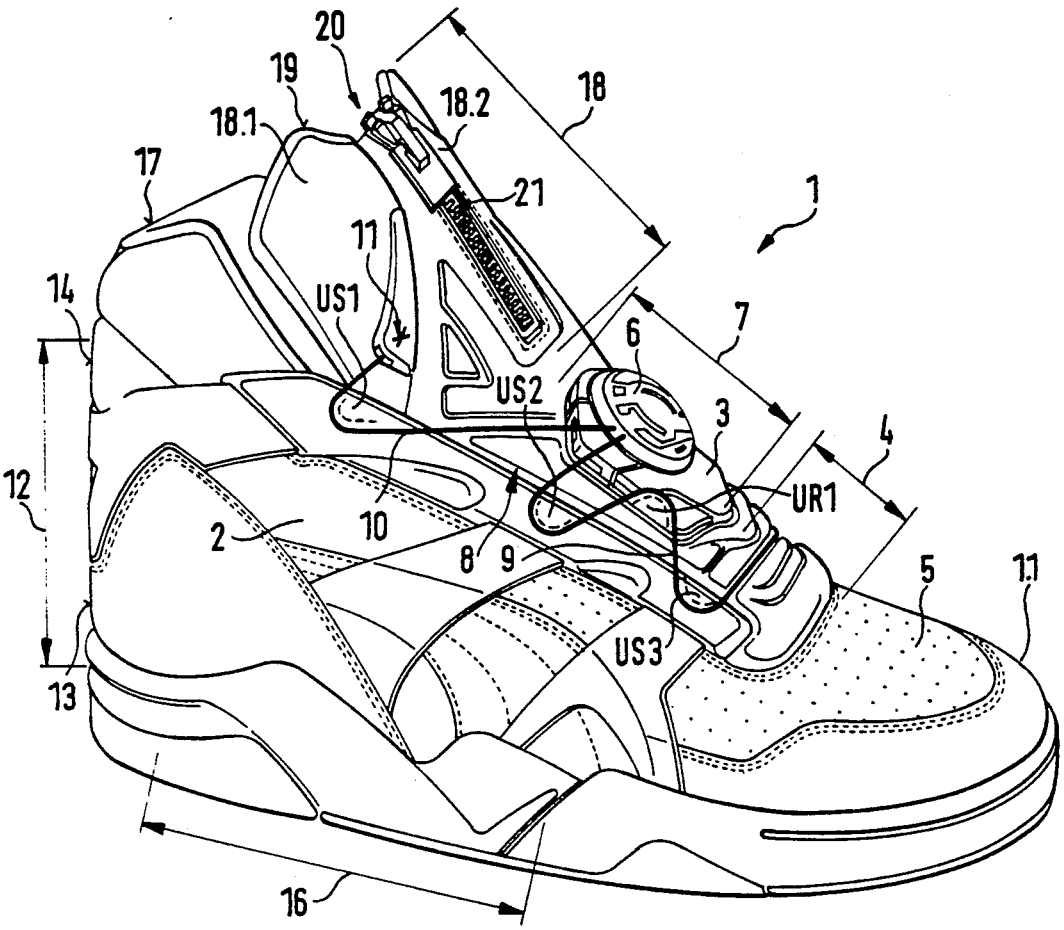
FIG. 1 is a perspective view of a shoe with a high top upper.

In FIG. 1, a shoe 1, especially an athletic, leisure or rehabilitation shoe, has an upper with side parts 2 which extend above the ankle, of which only one is visible, and an instep cover 3, which may be a separate cover element that is movable like a tongue or which may be formed by the tongue or a part of it or attached to it; as such, all future references to the term "instep cover" should be construed in this context as encompassing any of these possibilities. Instep cover 3 is connected with the material 5 of the upper shoe 1 in the metatarsophalangeal joint area 4.

Instep cover 3 is provided with a central rotary closure 6 and with a zipper closure 7. Central rotary closure 6 is preferably present in a section 7 located approximately between the center of instep cover 3 and ankle joint area 8.

A tightening element 9 running downward and forward toward shoe tip 1.1 and a tightening element 10 running upward and rearward toward the top of the shoe are coupled with central rotary closure 6. Tightening element 10 can be permanently connected to the instep cover at an attaching point 11 that is located above the ankle joint area 8. In this case, another tightening element 10 is provided on the opposite side of the shoe, and is permanently connected with the instep cover at a symmetrically placed attaching point.

Figure 3:
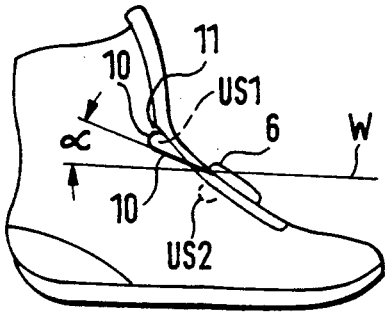
FIG. 3 is a schematic side view of the shoe of FIG. 1 illustrating a preferred angular position of the tightening element from the central rotary closure to the first guide element.

Tightening element 10 is guided over a first guide element US1 on an upper portion of the side part 2 and runs from there to an attaching point 11 on instep cover 3 which is at least as high as the point where the tightening element exits the end of a guiding groove or channel of the guide element US1. The guiding groove or the guide channel of this upper guide element US1 begins either at the height of the central rotary closure 6 or, especially significantly, higher than the rotary closure 6, and ends still higher. As a result, tightening element 10 preferably runs at an angle $\alpha$, which is about 10° to 50°, especially about 20° to 40°, measured between a horizontal line W which passes through the point where tightening element 10 exits the central rotary closure 6 and the point at which the tightening element 10 enters the guiding groove or channel of the guide element US1 (see FIG. 3). As a result, a rearward tightening action is produced in a section 12 of an area between heel 13 and heel upper 14, and thus, a good holding of the foot in shoe 1 is achieved.

Figure 2:
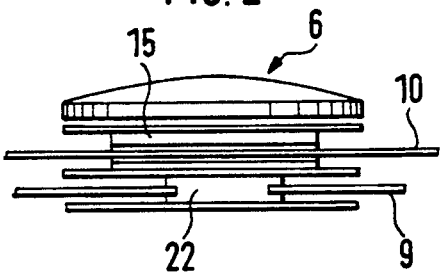
FIG. 2 is a diagrammatic view of winding elements for the tightening elements.

According to a modification, in the shoe representation in FIG. 1, instead of using a pair of tightening elements 10, a single tightening element 10 can be guided from attaching point 11 on one side of the shoe upper to winding element 15 (see FIG. 2) of central rotary closure 6, by which it is wound and unwound, and from there to the attaching point 11 on the opposite side of the shoe upper.

Tightening element 9, running in the direction of shoe tip 1.1, is guided from central rotary closure 6 over a guide element US2 provided on the central portion of side part 2, to a guide element UR1 on instep cover 3, then over another guide element US3 on the lower portion side part 2 of the upper, across the instep to the opposite side of the upper where it passes in a corresponding way back to central rotary closure 6. Guide element US2 is placed so that the tightening action acting on it is directed, on the lateral (outer) of the shoe, toward an area 16 between the heel and the metatarsal bone and on the inner (medial) side of the shoe toward an area between the heel and the arch of the foot. The guide elements over which the tensioning elements pass may be of the types shown and described in the above-noted U.S. Pat. Nos. 5,177,882 and 5,117,567.

The section 18 of instep cover 3 located above the central rotary closure 6, and preferably projecting above upper edge 17 of the shoe upper, is divided by a separation slot 20 which opens toward an upper edge 19 and extends basically in a lengthwise direction of instep cover 3. Separating slot 20 can be opened and closed by a quick-release slot closure 21, for example by a zipper or a sliding closure. Alternatively, parts 18.1, 18.2 of section 18 can be made to overlap, and in such a case, a VELCRO hook and loop material closure can be used to enable them to be joined or opened correspondingly wide.

Central rotary closure 6 is, preferably, designed so that it can wind or unwind in each case a greater length of tightening element 10 than that of tightening element 9 per unit of angle of rotation. For this purpose, the diameter of winding element 15 of central rotary closure 6 for the winding of tightening element(s) 10 is advantageously greater than that of winding element 22 (see FIG. 2) for winding tightening element 9. Both winding elements 15, 22 can basically be jointly operated. But, it can also be advantageous to enable the winding elements 15, 22 to be separately operable (as is the case for the winding device of the above-noted U.S. Ser. No. 07/010,385), and thus enable independent tightening of the tightening elements 9, 10. Finally, lockable central rotary closure 6 can be provided in a way known in the art with a quick release device.

If the above-described shoe with a high top upper is to be used as a rehabilitation shoe, additional support elements in the ankle area and special guiding areas in the outside area can preferably be provided which make possible an especially good hold of the foot in the shoe and as unimpeded as possible a sliding movement of such a rehabilitation shoe on the assigned bottom surface, such being known from U.S. Pat. Nos. 4,726,126 and 4,727,660, respectively.

While only a single embodiment in accordance with the present invention has been shown, as is apparent from the possible modifications described, the invention is not limited thereto, and is susceptible of numerous changes and modifications as will be known to those skilled in the art. Therefore, the invention is not to be limited to the details shown and described herein, and is, instead, intended to include all such changes and modifications as are encompassed by the scope of the appended claims.

I claim:

1. A shoe having an upper which is high enough to cover an ankle joint of the foot of a wearer and which is formed of a flexible material at least in side parts thereof, an instep cover covering an instep of the foot, at least two tightening elements which can be would for closing the shoe and can be extended for opening it, and a central rotary closure located on the instep cover in a section between a metatarsophalangeal joint area and an ankle joint area and coupled with the at least two tightening elements; wherein at least one of said tightening elements acts on a portion of a throat area of the shoe extending from the central rotary closure toward a tip of the shoe being alternately guided between guide elements on each of the side parts and respective guide elements of the instep cover; wherein at least one other of the tightening elements runs upwardly and rearwardly from the central rotary closure to an upper guide element on each side part of the upper and runs from the upper guide element to an attaching point on the instep cover which is located at approximately at least the same height as a point at which the at least one other of the tightening elements exits from said upper guide element, so that a rearward tightening action can be produced in an area between top and bottom parts of a heel portion of the upper.

2. Shoe according to claim 1, wherein said at least one other of the tightening elements runs from the central rotary closure to the upper guide element at an angle $\alpha$ of about 10° to 50° with respect to a horizontal line which passes through the ankle area.

3. Shoe according to claim 2, wherein said angle $\alpha$ is about 20° to 40°.

4. Shoe according to claim 1, wherein the at least one of the tightening elements which runs downwardly from the central rotary closure is guided over a central one of the guide elements on the side part, said central one of the guide elements being placed on the lateral side of the shoe so that a tightening action is produced by the downwardly running tightening element on the central guide element on the lateral side of the shoe which is directed toward an area between the heel and the metatarsal bone of the wearer's foot, and said central one of the guide elements being placed on the medial side of the shoe so that a tightening action is produced by the downwardly running tightening element on the central guide element on the medial side of the shoe which is directed toward an area between the heel and the arch of the wearer's foot.

5. Shoe according to claim 4, wherein the central rotary closure is located between the center of the instep and the ankle joint area.

6. Shoe according to claim 5, wherein an upper section of the instep cover located above the central rotary closure has a longitudinal separating slot which opens toward an upper edge of the instep cover; and wherein quick-release closure is provided for opening and closing said separating slot.

7. Shoe according to claim 6, wherein slot quick-release closure is made a zipper.

8. Shoe according to claim 6, wherein parts of the upper section of the instep cover overlap and said quick-release closure is a hook and loop material closure on the overlapping parts.

9. Shoe according to claim 7, wherein the windable length of the at least one tightening element which runs upward from the central rotary closure is greater than that of the at least one tightening element which runs downward from the central rotary closure.

10. Shoe according to claim 9, wherein the central rotary closure has a winding element for the at least one tightening element which runs upward therefrom which has a larger winding diameter than a winding element of the central rotary closure for the at least one tightening element which runs downward therefrom.

11. Shoe according to claim 10, wherein the winding elements have means for enabling them to be jointly operable.

12. Shoe according to claim 10, wherein the winding elements have means for enabling them to be operable independent of one another.

13. Shoe according to claim 1, wherein the central rotary closure is located between the center of the instep and the ankle joint area.

14. Shoe according to claim 1, wherein the windable length of the at least one tightening element which runs upward from the central rotary closure is greater than that of the at least one tightening element which runs downward from the central rotary closure.

15. Shoe according to claim 14, wherein the central rotary closure has a winding element for the at least one tightening element which runs upward therefrom which has a larger winding diameter than a winding element of the central rotary closure for the at least one tightening element which runs downward therefrom.

16. Shoe according to claim 15, wherein the winding elements have means for enabling them to be jointly operable.

17. Shoe according to claim 15, wherein the winding elements have means for enabling them to be operable independent of one another.

18. Shoe according to claim 1, wherein an upper section of the instep cover located above the central rotary closure has a longitudinal separating slot which opens toward an upper edge of the instep cover; and wherein quick-release closure is provided for opening and closing said separating slot.

19. Shoe according to claim 18, wherein the quick-release closure is made as a zipper.

* * * * *